US005717982A

United States Patent [19]

Statt

[11] Patent Number: 5,717,982

[45] Date of Patent: Feb. 10, 1998

[54] ELECTROSTATOGRAPHIC REPRODUCTION MACHINE INCLUDING OPTICS ASSEMBLY REALIGNMENT TOOL

[75] Inventor: William L. Statt, Webster, N.Y.

[73] Assignee: Xerox Corporation, Stamford, Conn.

[21] Appl. No.: 807,495

[22] Filed: Feb. 27, 1997

[51] Int. Cl.[6] ..... G03G 15/04

[52] U.S. Cl. ..... 399/126; 29/281.5; 355/60; 399/212

[58] Field of Search ..... 399/126, 211, 399/212; 355/55, 60, 61, 66; 29/281.1, 281.5

[56] References Cited

U.S. PATENT DOCUMENTS

| | | | |
|---|---|---|---|
| 4,155,641 | 5/1979 | Sagara et al. | 355/8 |
| 4,367,945 | 1/1983 | Abe | 355/51 |
| 4,500,197 | 2/1985 | Dannatt | 355/8 |
| 4,603,963 | 8/1986 | Hinton et al. | 355/8 |
| 4,634,267 | 1/1987 | Jones et al. | 355/66 |
| 4,710,017 | 12/1987 | Watanabe et al. | 355/8 |
| 4,939,545 | 7/1990 | Sakamoto et al. | 355/55 |

*Primary Examiner*—Joan H. Pendegrass
*Attorney, Agent, or Firm*—Tallam I. Nguti

[57] ABSTRACT

In an electrostatographic reproduction machine having a charged imaging member and an optics assembly for forming a properly registered latent image on the charged imaging member, a quick and precise optics assembly realignment tool mounted removably within the machine for realigning the optics assembly, after repair or remanufacture of such optics assembly. The realignment tool includes a generally rectangular frame having four sides forming four corners, and three non-adjustable position leg members, that are formed integrally with the frame at three of the four corners for initially locating and referencing the frame relative to a reference surface within the machine. The tool also includes one adjustable position leg member mounted slidably for adjustable movement at a fourth corner for initially compensating for any runout of the reference surface, so as to achieve a properly aligned optics assembly within the machine. The tool further includes first and second adjustable position finger members mounted slidably on a first and a second, opposite sides, of the four sides, and between leg members, for firmly setting an aligned position of a second carriage of the optics assembly relative to a first carriage thereof. The first and the second adjustable position finger members, and the adjustable position leg member, are mounted slidably within a first and a second slot portions in a bottom surface of the frame. Further, the adjustable position leg member and the first and the second adjustable position finger members, each include means for firmly binding each to the frame so as to cooperatively with the non-adjustable position leg members, firmly set positions of the first and the second carriages respectively, when properly aligned, relative to the reference surface within the machine.

10 Claims, 3 Drawing Sheets

ELECTROSTATOGRAPHIC REPRODUCTION MACHINE INCLUDING OPTICS ASSEMBLY REALIGNMENT TOOL

BACKGROUND

The present invention relates generally to electrostatographic reproduction machines, and more particularly concerns a quick and precise optics assembly realignment tool, for use, for example, in the field, for realigning the optics assembly of such a machine after replacement following repair or remanufacture of such optics assembly.

In an electrostatographic document reproduction machine, an original document containing an image to be reproduced is typically placed on a stationary platen of the machine and illuminated by an incremental line-scanning optical system or assembly. Reflected light rays from the document travel along an optical path and are projected by a lens, and in proper registration, onto a fixed path image frame of a charged photosensitive imaging member of the machine to form a latent image. The latent image of the document formed on the imaging member is then developed by appropriate marking or toner material, and the developed image is thereafter transferred in proper registration to a recording medium, such as a copy sheet of paper.

Various types of optics assemblies are known in the art, but the most widely used optics assemblies utilize scanning components, including elongated illuminated lamps and scan mirrors, which are typically supported onto a pair of guide rails mounted in a parallel plane beneath the document platen of the machine. The scanning components usually are contained in one or more movable scan carriages which are driven by a cable or belt arrangement so as to be movable back and forth on the guide rails beneath the platen. Examples of such prior art scan assemblies or systems, utilizing an elongated illuminated lamp and scan mirrors to scan/illuminate document images, are disclosed in U.S. Pat. Nos. 4,367,945, 4,155,641 and 4,603,963.

The document image to be reproduced may also be scanned by a raster input type scanner (RIS), typically a CCD sensor array. The RIS type scanner is supported for movement beneath the document platen and is moved in the scan, re-scan direction by a scan assembly basically similar to the ones used in the above-identified patents. U.S. Pat. No. 4,500,197, for example, discloses a RIS type scanner or scanning system.

In general, each prior art scanning system can be characterized as being secured to, and supported by, the sides of a frame assembly. Thus, U.S. Pat. No. 4,367,945 to Abe discloses a scanning support structure for an electrostatic copying machine comprising a guide rail and a guide rod which together support and absorb the loads of two movable carriages while being supported by frame members. U.S. Pat. No. 4,155,641 to Sagara et al. discloses a scanning apparatus comprising three parallel guide rods that are attached to a beam member, which supports the loads imposed by two movable optical scanning carriages. U.S. Pat. Nos. 4,603,963 to Hinton et al., and 4,710,017 to Watanabe et al. are references which disclose scanning systems comprising a pair of frame supported parallel guiding members that absorb the shock and loads of a moving carriage apparatus within an electrostatic copying machine. U.S. Pat. No. 4,500,197 to Dannatt discloses a support structure for a flat bed scanner comprising a pair of parallel, elongated guide rods fixed to left and right end plates which form rigid support for the loads imposed by a movable RIS optical scanning carriage assembly.

In order for an electrostatographic machine that includes a scanning assembly as above to be capable of producing high quality images, the optics assembly must be properly aligned and registered to a fixed path image frame of the photoreceptor or photoconductive member. In particular, the carriages as above, which contain the optical components, each need to be parallel to a start of scan position line, and to each other. Additionally, these carriages need to be perpendicular or squared to the optical path of movement thereof in order to produce an image that is properly aligned to the fixed path image frame of the photoreceptor.

A properly aligned or realigned optics assembly will form a latent image on the photoreceptor that when properly transferred to a copy sheet of paper, will place the image on the copy paper so that it is parallel to a lead edge of the paper. Additionally, the image on the paper will be parallel to the side edges of the paper, and overall will be properly registered on the particular size of paper sheet.

During initial manufacture and assembly of a machine including such an optics assembly, proper alignment of the optics assembly is usually achieved by trial and error, and means of expensive tooling and fixtures. What is proper alignment for the optics assembly of a machine of a particular machine model is usually thus attained by trial and error settings and result testing, and hence will vary by individual machine. From machine to machine each optics assembly will therefore have its own particular carriage positions, due to differences in lens conjugate lengths and other minor variables.

Unfortunately however, the optical components in one or in both of a two carriages of the optics assembly of each machine do tend to, and actually do fail in the field, thus requiring repair or remanufacture thereof, and reinstallation or replacement in the same machine. Trial and error methods of attempting to realign an optics assembly of the sort, after repairs or remanufacture, are ordinarily tedious and time consuming. For example, positions of the carriages are initially only set approximately or nominally, and copies are then run and evaluated for proper registration. Adjustments are then made to the positions of the reinstalled carriage or carriages, and final positions are thus reached only by trial and error. Even so, the actual trial and error results from such methods are usually only close to, but rarely ever as good as the initial production-quality alignment of that optics assembly.

SUMMARY OF THE INVENTION

According to the present invention, there is provided in an electrostatographic reproduction machine having a charged imaging member and an optics assembly for forming a properly registered latent image on the charged imaging member, a quick and precise optics assembly realignment tool mounted removably within the machine for realigning the optics assembly, after repair or remanufacture of such optics assembly. The realignment tool includes a generally rectangular frame having four sides forming four corners, and three non-adjustable position leg members that are formed integrally with the frame at three of the four corners for initially locating and referencing the frame relative to a reference surface within the machine. The tool also includes one adjustable position leg member mounted slidably for adjustable movement at a fourth corner for initially compensating for any runout of the reference surface, so as to achieve a properly aligned optics assembly within the machine. The tool further includes first and second adjustable position finger members mounted slidably on a first and a second opposite sides of the four sides, and between leg members, for firmly setting an aligned position of a second carriage of the optics assembly relative to a first carriage thereof. The first and the second adjustable position finger members, and the adjustable position leg member, are mounted slidably within a first and a second slot portions in a bottom surface of the frame. Further, the adjustable position leg member and the first and the second adjustable position finger members, each include means for firmly binding each to the frame so as to, cooperatively with the nonadjustable position leg members, firmly set positions of the first and the second carriages respectively, when properly aligned, relative to the reference surface within the machine.

BRIEF DESCRIPTION OF THE DRAWINGS

In the detailed description of the invention as presented below, reference is made to drawings in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
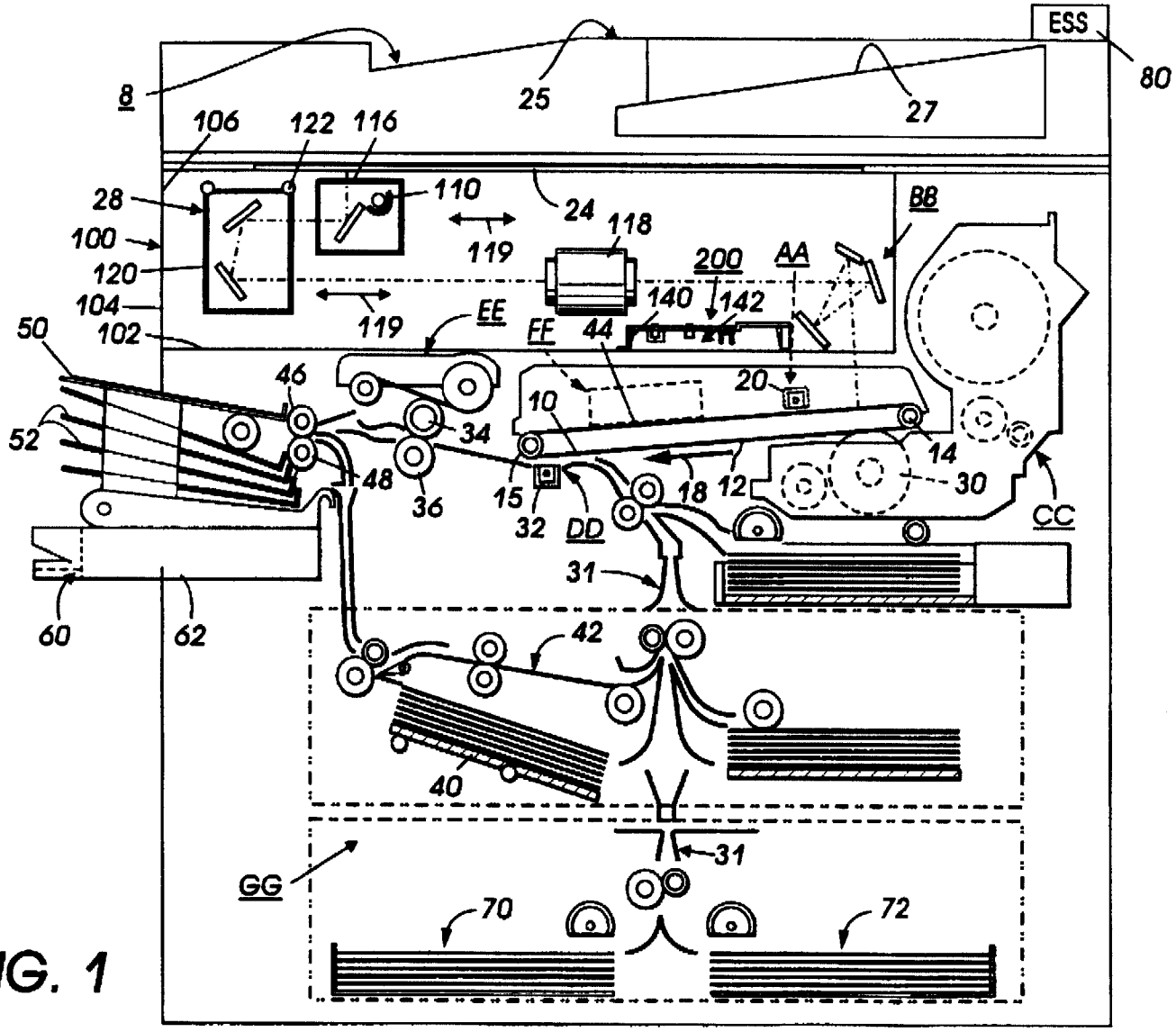
FIG. 1 is a vertical schematic of an exemplary electrostatographic reproduction machine including the optics assembly and realignment tool therefor in accordance with the present invention.

Referring first to FIG. 1, an exemplary electrostatographic reproduction machine 8 according to the present invention is illustrated. As shown, the machine 8 has conventional image processing stations associated therewith, including a charging station AA, an imaging/exposing station BB including an optics assembly 28, a development station CC, a transfer station DD, a fusing station EE, and a cleaning station FF. Importantly, the machine 8 includes an optics assembly realignment tool in accordance with the present invention, shown generally as 200, for quick and effective, non-trial and error realignment, after repair or remanufacture of the optics assembly of the machine, (to be described in detail below).

As illustrated, the machine 8 has a photoconductive belt 10 with a photoconductive layer 12 which is supported by a drive roller 14 and a tension roller 15. The drive roller 14 functions to drive the belt in the direction indicated by arrow 18. The drive roller 14 is itself driven by a motor (not shown) by suitable means, such as a belt drive.

The operation of the machine 8 can be briefly described as follows. Initially, the photoconductive belt 10 is charged at the charging station AA by a corona generating device 20. The charged portion of the belt is then transported by action of the drive roller 14 to the imaging/exposing station BB where a latent image, corresponding to the image on a document positioned on a platen 24, is formed via a properly aligned optics assembly 28 of the imaging/exposing station BB (to be described in detail below), on the belt 10. It will also be understood that the light lens imaging system can easily be changed to an input/output scanning terminal or an output scanning terminal driven by a data input signal to likewise image the belt 10. As is also well known, the document on the platen 24 can be placed there manually, or it can be fed there automatically by an automatic document handler device 25 that includes a multiple document sheet holding tray 27.

The portion of the belt 10 bearing the latent image is then transported to the development station CC where the latent image is developed by electrically charged toner material from a magnetic developer roller 30 of the developer station CC. The developed image on the belt is then transported to the transfer station DD where the toner image is transferred to a copy sheet fed by a copy sheet handling system 31. In this case, a corona generating device 32 is provided for charging the copy sheet so as to attract the charged toner image from the photoconductive belt 10 to the copy sheet. The copy sheet with the transferred image thereon is then directed to the fuser station EE. The fuser apparatus at station EE includes a heated fuser roll 34 and backup pressure roll 36. The heated fuser roll 34 and pressure roll 36 rotatably cooperate to fuse and fix the toner image onto the copy sheet. The copy sheet then, as is well known, may be selectively transported to a finishing area GG, or to a duplex tray 40 along a selectable duplex path 42 for duplexing.

The portion of the belt 10 from which the developed image was transferred is then advanced to the cleaning station FF where residual toner and charge on the belt are removed by a cleaning device such as a blade 44, and a discharge lamp (not shown) in order to prepare the portion for a subsequent imaging cycle.

When not doing duplex imaging, or at the end of such duplex imaging, the copy sheets upon finally leaving the fusing rolls 34, 36, are passed to finishing area input rolls 46 and 48. From the input rolls 46, 48, the copy sheets are fed, for example, individually to an output tray (not shown) or to a bin sorter apparatus 50 where the sheets can be arranged in a collated unstapled set within the tray or within each bin 52 of the bin sorter apparatus. A machine user or operator making such a set of copy sheets on the reproduction machine 8 can thus manually remove each such set at a time, and insert a corner or edge of the set into a convenience stapler assembly 60, for convenient stapling. As shown, the convenient stapler assembly 60 is built into a portion 62 of the frame of the machine 8, and at a location conveniently close to the bin sorter apparatus or output tray.

The various machine stations and subsystems described hereinabove are typically regulated by an electronic subsystem (ESS) 80 which is preferably a controller such as a programmable microprocessor capable of managing all of the machine functions. Among other things, the controller provides a comparison count of the copy sheets, all necessary counting including the number of documents being recirculated, the number of copy sheets selected by the operator, machine timing and time delays, jam indications and subsystem actuation signals. Conventional sensors or switches may be utilized to keep track of the positions of moving parts such as moving optical carriages, moving documents and moving sheets in the machine. In addition, the controller regulates the various positions of gates and switching depending upon the mode of operation selected.

The foregoing description is believed to be sufficient for the purposes of the present application for patent to illustrate the general operation of an electrostatographic reproduction machine incorporating the features of the present invention. As previously discussed, the electrostatographic reproducing machine or apparatus may take the form of any of several well known systems including various printing and copying machines manufactured by Xerox Corporation. Variations of specific electrostatographic processing subsystems or processes may be expected without affecting the operation of the present invention.

Figure 2:
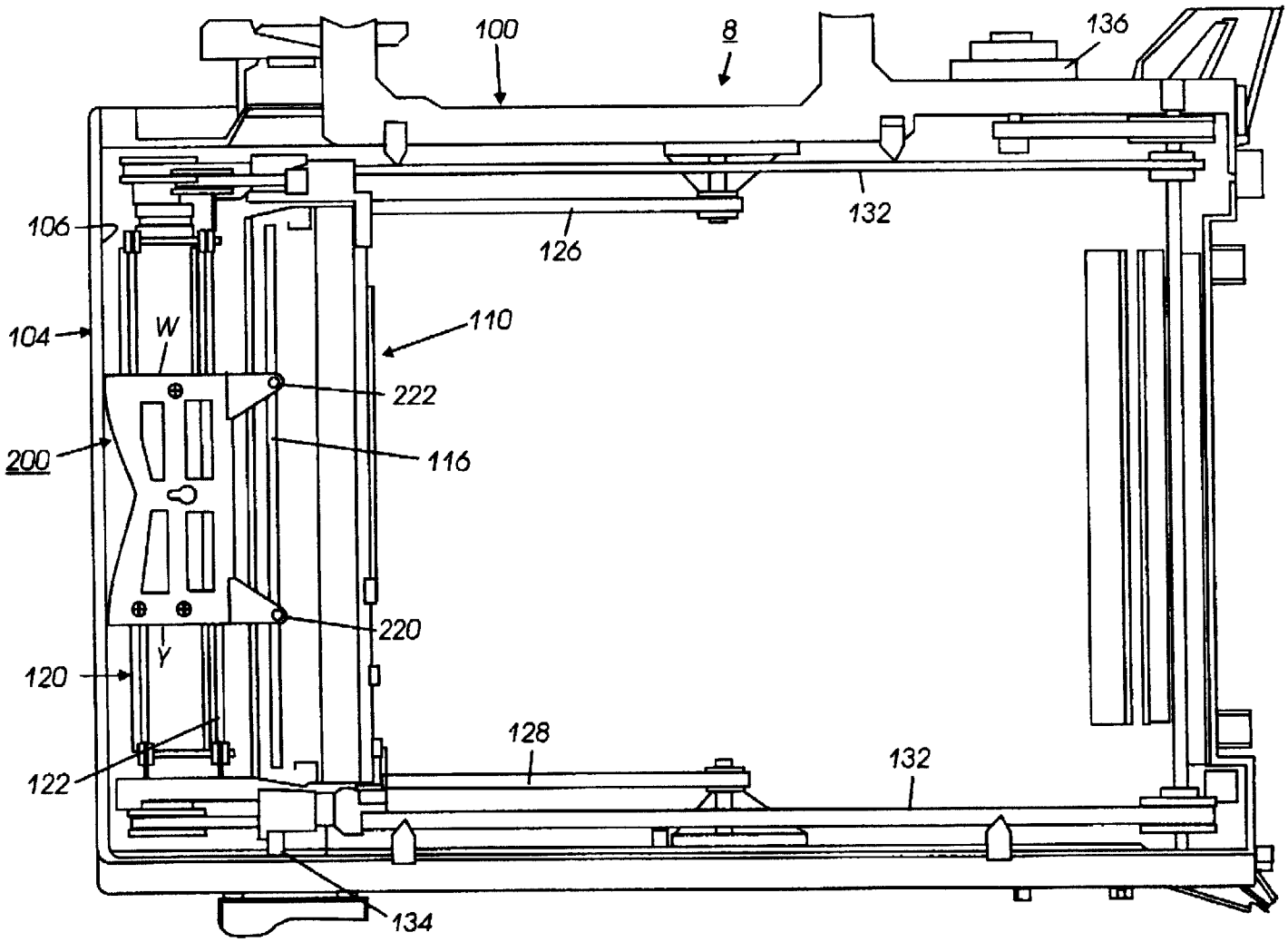
FIG. 2 is a top plan view of the optics assembly of FIG. 1.

Referring now to FIGS. 1 and 2, the properly aligned optics assembly 28 of the machine 8 is located within an optics housing 100. The optics housing 100 includes a top panel part of which is the platen 24, a floor shown as 102, and vertical walls, particularly including a reference wall 104 having an inside surface 106 nearest a home position for the optics assembly 28. As further shown, the optics assembly 28 includes a first carriage 110 spaced from the inside surface 106 and containing an elongate illumination lamp, a mirror and an exposure slit 116, along with appropriate openings for optimal optical system performance. The optics assembly 28 also includes a second carriage 120 that is also spaced from the inside surface 106 of wall 104, but has a position between the first carriage 110 and the inside 106. As illustrated, the second carriage 120 includes a pair of mirrors as shown, appropriate openings an upper right side (per FIG. 1) tie rod 122, and an upper left side (per FIG. 1) tie rod 124 that support the second carriage and are perpendicular to the path of movement of the carriages. As shown, both the first and second carriages 110, 120 respectively, are reversibly movable from their home positions (FIG. 1) in a scanning direction as shown by the arrows, along an optical path 119 under the platen 24, and back along the path 119 to such home positions.

As further shown in FIG. 1, the machine 8 includes the optics assembly realignment tool 200 of the present invention, for quick and effective, non-trial and error realignment, after repair or remanufacture, of the optics assembly 28. In accordance with the present invention, the tool 200 is mounted removably, for example by means of a screw 142, to a holding block 140 located within the optics housing 100.

As pointed out above, in order for the machine 8 to produce high quality images, the first carriage 110 and the second carriage 120, each need to be parallel to each other, and to be perpendicular or squared to the optical path 119 so as to produce an image that is properly aligned to a fixed path image frame of the of the photoreceptor 10, below the optics assembly.

A properly aligned or realigned optics assembly 28 will form a latent image on the photoreceptor 10 that when properly transferred to a copy sheet of paper, will place the image on the copy paper so that it is parallel to a lead edge of the paper. Additionally, the image on the paper will be parallel to the side edges of the paper, and overall, will be properly registered on the particular size of paper sheet.

In order for an optics assembly 28 of a machine to be properly aligned or realigned, both the first carriage 110 and the second carriage 120 have to each be parallel to an optics datum or start of scan position line as determined by an activated start of scan sensor 134. In addition, both the first carriage 110 and the second carriage 120 must be set to proper home positions so as to assure that overall conjugate length of the lens 118 is achieved. Each lens 118 has a slightly different conjugate length for each machine, thus carriage position settings for each optics assembly are unique.

In particular, the set position of the first carriage 110 in relation to the optics datum or start of scan position line is critical because it directly determines the proper or improper registration of each image formed, and because other machine functions are timed from movement of the first carriage relative to the start of scan position line.

Therefore, it is critical to set the positions of the carriages properly and precisely. During machine manufacture, such positions are achieved tediously, by trial and error, and with expensive tools. Once carriage positions are achieved as such, the first carriage 110 and the second carriage 120, are each locked into place for reciprocal movement along the path 119 by respective drive belts 126, 128, and 130, 132 (FIG. 2). As illustrated particularly in FIG. 2, the first carriage 110 is coupled to and driven by long belts 126, 128, and the second carriage 120, is coupled to, and driven by the short belts 130, 132.

The start of scan sensor 134 is activated and deactivated by movement of the first carriage 110, first in the scan direction from a home position (FIG. 2), and on return to the home position. When activated, the start of scan sensor 134 starts timing movement of the exposure slit 116 of the first carriage 110 in relation to a platen registration scheme, and to the position of an image frame of the photoreceptor 10 under the platen. The actual scan length is established by encoder pulses from the servo motor 136 of the optics assembly, which includes an encoder disc. An end of scan position is thus determined by encoder counts of the drive motor 136.

In accordance with the present invention, the optics assembly realignment tool 200 of the present invention is useful for avoiding tedious and time consuming trial and error methods of attempting to realign an optics assembly 28 of a machine 8, after repairs or remanufactures of such assembly. The optics assembly realignment tool 200 of the present invention is adjustable to match a production-quality, proper alignment of a properly aligned optics assembly 28 of a machine. After such adjustment, the tool 200 is then firmly set and mounted within the machine, for necessary, subsequent realignment of the optics assembly following repairs or remanufacture thereof.

The optics assembly realignment tool 200 of the present invention will therefore vary in its particular adjustment from machine to machine. The tool 200 for each machine will be adjusted and set to the optics assembly of that individual machine, and will be shipped as part of that individual machine. Subsequently, as for example in the field, the tool 200 for any such machine will enable a Technical Representative after repairing the optics assembly, or a remanufacturer of the optics assembly of that machine, to quickly, and without trial and error, achieve production-like quality results in realigning the optics assembly.

Figure 3:
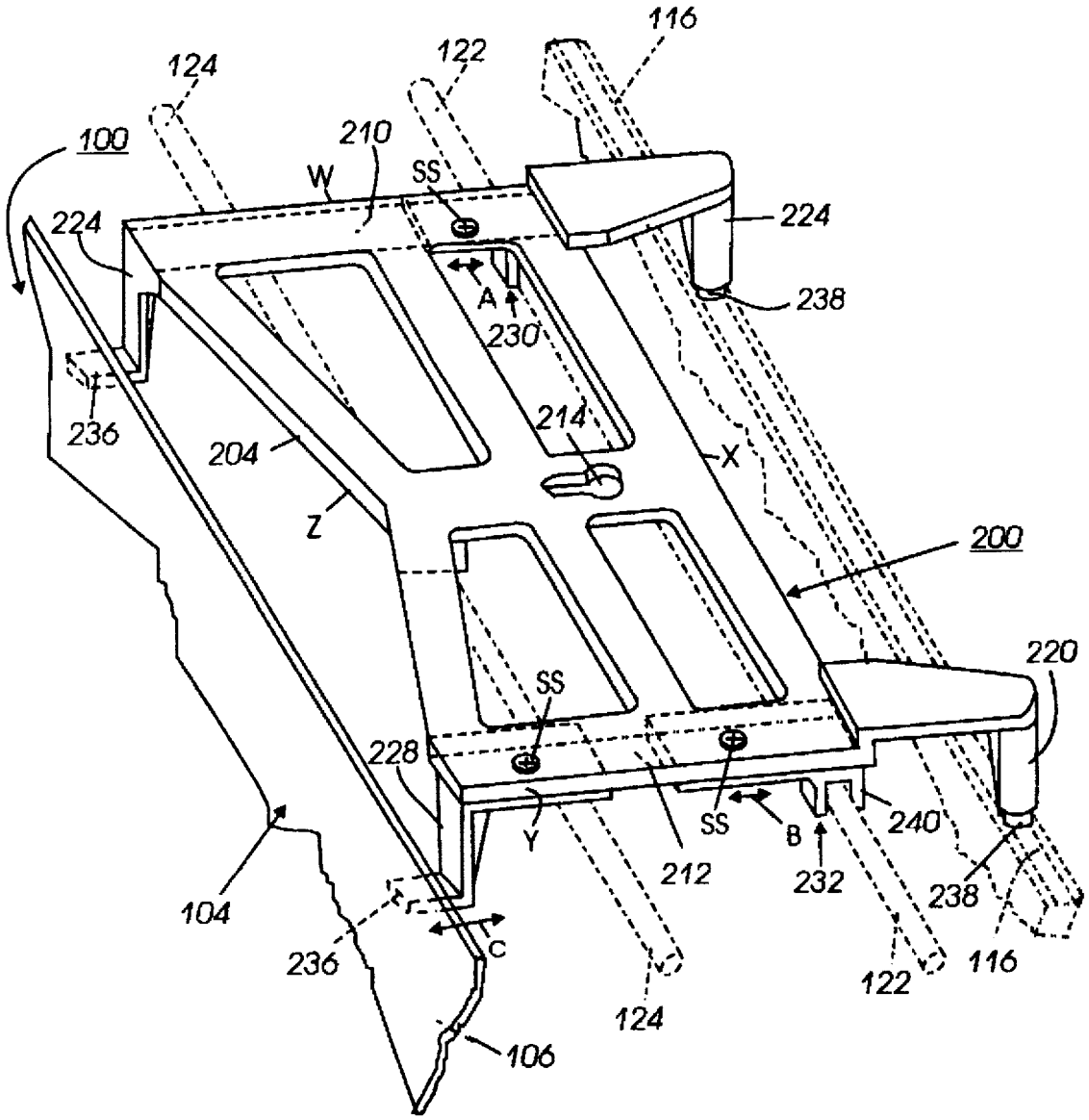
FIG. 3 is a perspective view of the optics assembly realignment tool in accordance with the present invention

The optics assembly realignment tool 200 is particularly useful for realigning at least one of the first carriage 110 and the second carriage 120 of the optics assembly after repairs thereto. As illustrated in FIG. 3, the optics assembly realignment tool 200 includes a generally rectangular frame 204 having four sides W, X, Y and Z which form four corners. The tool 200 importantly includes three non-adjustable position leg members 220, 222, and 224, that are formed integrally with the frame 204 at three of the four corners. The three non-adjustable position leg members are for initially locating and referencing the frame 204 relative to a home position (FIG. 2) of the first carriage 110 of the optics assembly 28.

The tool 200 also includes one adjustable position leg member 228 mounted slidably for adjustable movement at a fourth of the four corners for initially compensating for any runout of a reference surface, such as the inside surface 106 of the reference wall 104. Further, the tool 200 includes a first adjustable position finger member 230 mounted slidably on a first side W of the four sides between two non-adjustable position leg members 222 and 224 for marking or firmly setting an aligned position of the second carriage 120 relative to the first carriage 110. It also includes a second adjustable position finger member 232 mounted slidably on a second side Y, opposite the first side W, and between a non-adjustable position leg member 220, and the adjustable position leg member 228, for marking or firmly setting an aligned position of the second carriage 120 relative to the first carriage 110, at the second end of the frame 204.

The frame 204 as illustrated preferably includes a top surface, and a bottom surface. The bottom surface has a first slot portion 210 at the first end or side W of the frame 204, and a second slot portion 212 at the second end Y of the frame 204. The first and the second finger members 230, 232 are mounted slidably within the first and the second slot portions, 210, 212 of the frame 204, respectively. The adjustable position leg member 228 is mounted slidably within the second slot portion 212 of the frame 204. The frame 204 includes a centrally located means, such as a screw mounting hole 214, for mounting the frame 204 to the holding block 140 within the reproduction machine as shown in FIG. 1.

As further illustrated, the adjustable position leg member 228 and the first and the second adjustable position finger members 230, 232 each include means, such a set screw SS, for firmly binding each to the frame 204, in order to cooperatively with the non-adjustable position leg members, mark positions of the first and the second carriages 110, 120 respectively, when properly aligned, relative to the reference surface 106 within the machine. The adjustable position leg member 228 and one, 224, of the three non adjustable position leg members each include a horizontal spacer portion 236 as shown, and are located at opposite corners of a third side Z of the frame 204 for contacting the reference surface 106 within the reproduction machine, when the first and the second carriages 110, 120 are properly realigned. Two of the three non adjustable position leg members 220, 222 each include a locating cylindrical tip portion 238 as shown, and are located at opposite corners of a fourth side X, opposite the third side of the frame 204, for inserting into the aligned exposure slit 116 of the first carriage 110. As also illustrated, each of the adjustable position finger members 230, 232 includes a forked tip 240 for fitting over the right side (FIG. 3) aligned tie rod 122 on the second carriage 120 in order to align the second carriage 120 relative to the first carriage 110.

Initially, in order to adjust and firmly set the tool 200 to a particular properly aligned optics assembly of a machine, the locking or set screws SS are loosened, thus leaving the first and second finger members 230, 232, as well as, the adjustable position leg member 228, loose. The cylindrical tips 238 of the non-adjustable leg members 220, 222 are placed into the exposure slit 116 of a properly aligned first carriage 110. The tool 200 is located as such so that it is at a central position front to back (that is one end to the other of the elongate carriage) within the slit 116. A properly aligned second carriage should also be in its position relatively to the first carriage. The adjustable position first and second finger members 230, 232 are then moved adjustably relative to the second carriage, until the forked tips 240 thereto fit over the right hand tie rod 122 of the second carriage 120. The first and second carriages are then moved to their relative home positions (FIG. 2) adjacent the reference wall 104 so that the horizontal spacer portion 236 of at least the non-adjustable position leg member 224 is in contact with the inside 106 of the reference wall 104. The adjustable position leg member 228 is then moved adjustably until it too is also in contact with the inside surface 106.

The locking or set screws SS are then tightened in order to hold and firmly set the finger members 230, 232 over right tie rod 122, as well as the adjustable position leg member 228. The tool 200 as adjusted to the properly aligned first and second carriages of the optics assembly 28 and the reference wall 104, as such, is then included within the optics assembly housing 100, for example, by mounting it to the holding block 140 (FIG. 1) using a removable fourth screw 142 (FIG. 1) through the screw hole 214.

In order to use the tool 200 after optics assembly repairs or remanufacture, the repairer or remanufacturer leaves the locking screws SS as firmly set above, and does not loosen them. If the tool when matched to the optics assembly indicates that some realignment is necessary, then the repairer or remanufacturer will instead loosen either the first carriage 110 or the second carriage 120 at an appropriate end thereof. The firmly set tool is placed centrally front to back on the carriages, with the cylindrical tips 238 of the leg members 220, 222 inserted into the exposure slit 116 of the first carriage 110, and the finger members 230, 232 fitted over the right hand tie rod 122 of the second carriage 120. The loosened carriage is then moved and adjusted until the spacer portions 236 of the leg members 224, 228 (as firmly set) are in contact with the inside 106 of the reference wall 104. The realignment of the repaired or replaced and loosened carriage thus is achieved in a manner that is quick, easy and is non-trial and error. The loosened carriage is then retightened and locked into such a proper realignment position, thus achieving production-quality realignment quickly and easily without costly and time consuming trial and error.

Specifically, to use the tool for realignment of a second carriage 120, that is being installed after repairs or remanufacture thereof, the firmly set tool 200 is removed from the holding block 140. The second carriage 120 and the first carriage 110 are moved towards the left side reference wall 104 of the optics housing 100. There the second carriage is loosened at its end drive supports to allow slight adjustments in its position. The two locating cylindrical tips 238 of leg members 220, 222 of the firmly set tool 200 are inserted centrally (front to back) into the exposure slit 116 of the first carriage 110. The repairer or remanufacturer is clearly instructed NOT TO LOOSEN ANY SCREWS ON THE TOOL!. The loosened second carriage 120 is then moved adjustably towards the first carriage 110 until the forked tips 240 of the adjustable position fingers 230, 232 of the tool, fit over the right tie rod 122 of the second carriage 120. The second carriage 120 is then retightened and locked to its drive supports, and into this position with the adjustable position fingers 230, 232 over the tie rod 122, and the locating cylindrical tips of leg members 220, 222 within the exposure slit 116.

To use the tool for realignment of a first carriage 110, that is being installed after repairs or after remanufacture thereof, the firmly set tool 200 is removed from the holding block 140. The second carriage 120 and the first carriage 110 are moved towards the left side reference wall 104 of the optics assembly housing 100. There the first carriage 110 is loosened at its end drive supports in order to allow for slight adjustments in its position. The repairer or remanufacturer is clearly instructed NOT TO LOOSEN ANY SCREWS ON THE TOOL!. The adjustable position finger members 230, 232 are fitted over the right tie rod 122 of the second carriage, and centrally (front to back) over the tie rod. The second carriage is further moved gently leftwards towards the reference wall 104 until the spacer portions 236 of the leg members 224, 228 are in aligned contact against the inside 106 of the wall 104. The loosened first carriage 110 is then moved adjustably towards the second carriage 120 until the two locating cylindrical tips 238 of leg members 220, 222 (of the firmly set tool 200) are inserted into the exposure slit 116 of the first carriage 110. The first carriage 110 is then retightened and locked to its drive supports, and into this position. The tool 200 can then be removed and restored on the block 140 for further subsequent use.

To use the tool for realignment of a first carriage 110, and a second carriage 120 that have both been installed or replaced after repairs or after remanufacture thereof, the firmly set tool 200 is removed from the holding block 140. The second carriage 120 and the first carriage 110 are moved towards the left side reference wall 104 of the machine 8. There the first carriage 110 and the second carriage 120 are each loosened at one of their end drive supports at least in order to allow for slight adjustments in each of their positions. The repairer or remanufacturer is clearly instructed NOT TO LOOSEN ANY SCREWS ON THE TOOL!. The adjustable position finger members 230, 232 are fitted over the right tie rod 122 of the second carriage, and centrally (front to back) over the tie rod. The loosened second carriage 120 is (if necessary) further moved gently and adjustably leftwards towards the reference wall 104 until the spacer portions 236 of the leg members 224, 228 are in aligned contact against the inside 106 of the wall. The second carriage 120 is then retightened and locked to its drive supports, and into this position. The loosened first carriage 110 is then moved adjustably towards the second carriage 120 until the two locating cylindrical tips of leg members 220, 222 (of the firmly set tool 200) are inserted into the exposure slit 116 of the first carriage 110. The first carriage 110 is then also retightened and locked to its drive supports, and into this position with the two locating cylindrical tips of leg members 220, 222 within the exposure slit 116, and the forked tips of the finger members 230, 232 still over the tie rod 122.

While the invention has been described with reference to the structure disclosed, it will be appreciated that numerous changes and modifications are likely to occur to those skilled in the art, and it is intended to cover all changes and modifications which fall within the true spirit and scope of the invention.

I claim:

1. In an electrostatographic reproduction machine having an aligned optics assembly for forming a latent image of an original document image onto a charged image frame of a photoconductive imaging member, an optics assembly realignment tool for realigning at least one of a first carriage and a second carriage of the optics assembly after repairs thereto, the optics assembly realignment tool comprising;

(a) a generally rectangular frame having four sides defining four corners;

(b) three non-adjustable position leg members formed integrally with said frame at three of said four corners for initially locating and referencing said frame relative to a home position of the first carriage of the optics assembly;

(c) an adjustable position leg member mounted slidably for adjustable movement at a fourth of said four corners for initially compensating for any runout of a reference surface for a properly aligned optics assembly within the reproduction machine;

(d) a first adjustable position finger member mounted slidably on a first of said four sides between two non-adjustable position leg members for marking, at a first end of said frame, an aligned position of the second carriage to the first carriage; and (e) a second adjustable position finger member mounted slidably on a second side opposite said first side, and between a non-adjustable position leg member and said adjustable position leg member for marking, at a second end opposite said first end of said frame, an aligned position of the second carriage to the first carriage.

2. The optics assembly realignment tool of claim 1, wherein said frame includes a top surface, and a bottom surface, said bottom surface having a first slot portion at said first end of said frame and a second slot portion at said second end of said frame.

3. The optics assembly realignment tool of claim 1, wherein said frame includes a centrally located means for mounting said frame to a holding block within the reproduction machine.

4. The optics assembly realignment tool of claim 1, wherein said first and said second finger members are mounted slidably within said first and said second slot portions of said frame, respectively.

5. The optics assembly realignment tool of claim 1, wherein said adjustable position leg member is mounted slidably within said second slot portion of said frame.

6. The optics assembly realignment tool of claim 1, wherein said adjustable position leg member and said first and said second adjustable position finger members each include means for firmly binding each to said frame for cooperatively with said non-adjustable position leg members, marking, relative to a reference surface within the machine, positions of the first and the second carriages when properly aligned.

7. The optics assembly realignment tool of claim 1, wherein said adjustable position leg member and one of said three non adjustable position leg members each include a horizontal spacer portion, and are located at opposite corners of a third side of said frame for contacting a reference surface within the reproduction machine, when the first and the second carriages of the optics assembly are properly realigned.

8. The optics assembly realignment tool of claim 1, wherein two of said three non adjustable position leg members each include a locating cylindrical tip portion, and are located at opposite corners of a fourth side, opposite said third side of said frame, for inserting into an aligned exposure slit of the first carriage of the optics assembly.

9. The optics assembly realignment tool of claim 1, wherein each said adjustable position finger member includes a forked tip for fitting over a tie rod on the second carriage for aligning the second carriage relative to the first carriage.

10. An electrostatographic reproduction machine for producing properly registered high quality toner images, even after replacement of its optics assembly, the reproduction machine comprising:

(a) a machine frame;

(b) a photoconductive member mounted to said frame and having an image bearing surface;

(c) a charging device for uniformly charging said image bearing surface;

(d) a development apparatus containing toner particles for developing a properly registered latent image formed on a uniformly charged said image bearing surface;

(e) transfer and fusing apparatus for transferring a toner particle developed image from said image bearing surface to a copy sheet of paper, and for fusing the toner particle image to the copy sheet;

(f) latent image forming means including, an optics assembly having an optics assembly housing, a replaceable first carriage and a replaceable second carriage containing optical components for exposing an original image, and when properly realigned after replacement, recording, in proper registration onto a frame of a uniformly charged said image bearing surface, a latent form of the original image for toner particle development; and (g) an optics assembly realignment tool mounted within said optics assembly housing for realigning at least one of said first carriage and said second carriages after replacement thereof, the optics assembly realignment tool including:

(i) a generally rectangular frame having four sides defining four corners;

(ii) three non-adjustable position leg members formed integrally with said frame at three of said four corners for initially locating and referencing said frame relative to a reference wall of said optics assembly housing adjacent a home position of said first carriage of said optics assembly;

(iii) an adjustable position leg member mounted slidably for adjustable movement at a fourth of said four corners for initially compensating for any runout of said reference;

(iv) a first adjustable position finger member mounted slidably on a first of said four sides between two non-adjustable position leg members for marking, at a first end of said frame, an aligned position of said second carriage to said first carriage; and (v) a second adjustable position finger member mounted slidably on a second side opposite said first side, and between a nonadjustable position leg member and said adjustable position leg member for marking an aligned position of said second carriage to said first carriage, at a second end opposite said first end of said frame.

* * * * *